US008991652B2

(12) United States Patent
Harrod

(10) Patent No.: US 8,991,652 B2
(45) Date of Patent: Mar. 31, 2015

(54) WATER COOLER APPARATUS

(75) Inventor: Richard Harrod, Erskineville (AU)

(73) Assignee: Breville Pty Limited, Botany, New South Wales (AU)

( * ) Notice: Subject to any disclaimer, the term of this patent is extended or adjusted under 35 U.S.C. 154(b) by 0 days.

(21) Appl. No.: 13/634,551

(22) PCT Filed: Mar. 30, 2011

(86) PCT No.: PCT/AU2011/000359

§ 371 (c)(1),
(2), (4) Date: Sep. 13, 2012

(87) PCT Pub. No.: WO2011/120085

PCT Pub. Date: Oct. 6, 2011

(65) Prior Publication Data

US 2013/0015208 A1 Jan. 17, 2013

(30) Foreign Application Priority Data

Mar. 31, 2010 (AU) ..... 2010901393

(51) Int. Cl.

| | |
|---|---|
| ***B67D 7/74*** | (2010.01) |
| ***B67D 3/00*** | (2006.01) |
| ***B67D 3/04*** | (2006.01) |

(52) U.S. Cl.

CPC ..... *B67D 3/0009* (2013.01); *B67D 3/0025* (2013.01); *B67D 3/04* (2013.01)

USPC ..... 222/144.5; 222/145.1; 222/145.5; 222/67

(58) Field of Classification Search

USPC ..... 222/67, 145.1, 145.6, 145.8, 144.5, 222/146.1, 146.6, 145.5, 64, 62, 189.06

See application file for complete search history.

(56) References Cited

U.S. PATENT DOCUMENTS

| | | | | |
|---|---|---|---|---|
| 4,792,059 | A * | 12/1988 | Kerner et al. | 222/67 |
| 5,911,341 | A * | 6/1999 | Donselman et al. | 222/129 |
| 7,905,374 | B2 * | 3/2011 | Yui | 222/67 |
| 8,083,104 | B2 * | 12/2011 | Roetker et al. | 222/146.1 |
| 2002/0130137 | A1 * | 9/2002 | Greenwald et al. | 222/54 |
| 2010/0116847 | A1 * | 5/2010 | Foroughi et al. | 222/81 |

* cited by examiner

*Primary Examiner* — Kevin P Shaver
*Assistant Examiner* — Robert Nichols, II
(74) *Attorney, Agent, or Firm* — Molins & Co. Pty. Ltd.

(57) ABSTRACT

A fluid dispensing assembly for providing a configurable fluid temperature. The assembly including: an adjustment interface; a mixing valve having a plurality of fluid ingress apertures and at least one fluid egress aperture; the mixing valve being adjustable to dispense fluid at a configurable temperature; and a dispenser element, in fluid communication with the at least on egress aperture of the mixing valve and adapted to selectively dispense water there from.

13 Claims, 15 Drawing Sheets

WATER COOLER APPARATUS

FIELD OF THE INVENTION

The present invention relates to fluid dispensers and in particular to fluid dispensers having a refrigerated reservoir.

The invention has been developed primarily for use as a water cooler and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

OBJECT OF THE INVENTION

It is an object of the present invention to overcome or ameliorate at least one of the disadvantages of the prior art, or to provide a useful alternative.

It is an object of the invention in its preferred form to provide a water cooler, wherein temperature of dispensed water is configurable across a range of temperatures.

SUMMARY OF THE INVENTION

According to an aspect of the invention there is provided a fluid dispensing assembly for providing a configurable fluid temperature, the fluid dispensing assembly comprising:

an adjustment interface;

a mixing valve having a plurality of fluid ingress apertures and at least one fluid egress aperture; the mixing valve being adjustable to dispense fluid at a configurable temperature; and a dispenser element, in fluid communication with the at least on egress aperture of the mixing valve and adapted to selectively dispense water there from.

Preferably, the plurality of ingress apertures are in fluid communication with a reservoir containing a single body of fluid. Most preferably, the fluid is supplied to the mixing valve under the influence of gravity. Most preferably, the received fluid from both the first portion and the second portion is at substantially the same pressure.

Alternatively, the fluid is supplied to the mixing valve under the influence of one or more pumps. Preferably, a pump is operatively associated with supplying water to each of the plurality of fluid ingress apertures.

Preferably, fluid dispensing assembly is used in combination with a fluid dispensing apparatus substantially as herein described.

According to an aspect of the invention there is provided a fluid dispensing apparatus comprising:

a cooling element;

a main reservoir for storing fluid, wherein the reservoir includes a first portion for storing fluid at a substantially ambient temperature; wherein the main reservoir includes a second portion for storing chilled fluid, the second portion being operatively associated with the cooling element;

a fluid dispensing assembly adapted to receive fluid from both the first portion and the second portion of the second reservoir at a settable ratio, thereby enabling fluid to be dispensed at a configurable temperature.

According to an aspect of the invention there is provided a fluid dispensing apparatus comprising:

a cooling element;

a first reservoir portion for storing fluid at a substantially ambient temperature;

a second reservoir portion for storing chilled fluid, the second portion being operatively associated with the cooling element;

a fluid dispensing assembly adapted to receive fluid from both the first portion and the second portion of the second reservoir at a settable ratio, thereby enabling fluid to be dispensed at a configurable temperature.

Preferably, a fluid dispensing apparatus can further comprise:

a preliminary reservoir for receiving fluid;

a filter in fluid communication with the preliminary reservoir and main reservoir, and the filter being adapted supplying filtered fluid to the main reservoir.

Preferably, the fluid dispensing assembly is located, in use, below the level of water contained in the main reservoir. More preferably, the fluid is supplied to the fluid dispensing assembly under the influence of gravity. Most preferably, the received fluid from both the first portion and the second portion is at substantially the same pressure.

Alternatively, the fluid is supplied to the fluid dispensing assembly under the influence of one or more pumps. Preferably, a pump is respectively operatively associated with supplying fluid from each of the first reservoir portion and the second reservoir portion to the fluid dispensing assembly.

The first reservoir portion and the second reservoir portion are preferably separate reservoirs. More preferably, the first reservoir portion and the second reservoir portion can be respectively stacked.

Preferably, the fluid is water.

According to an aspect of the invention there is provided a water level control assembly for restricting flow from the upper tank to a lower tank in response to water level in the lower tank. This water level control assembly comprises: a float housing defining a lower extent and an upper extent; and a float.

Preferably, the float housing includes one or more lower drain apertures for enabling fluid flow communication between the float housing and lower tank. More preferably the float housing includes one or more upper aperture for enabling fluid flow communication between the upper tank and float housing.

Preferably, the float includes a seal element for sealingly engaging an upper aperture for restricting fluid flow from the upper tank to the float housing.

Preferably, a release valve is operatively associated with the lower tank for releasing water there from.

Preferably, the water level control assembly can be included between the first portion (or chamber) and second portion (or cooling chamber) of a water dispensing apparatus as described herein.

According to an aspect of the invention there is provided a method of water level control for restricting flow from the upper tank to a lower tank in response to water level in the lower tank, comprising the steps of:

adding water to the upper tank;

enabling water to enter a float housing via an upper aperture, flow around a float and though a lower apertures into lower tank, thereby enabling filling of the lower tank;

water continues to enter the upper tank, filling the lower tank;

once the lower tank becomes full further water flow raises the float, enabling the a float seal to sealingly engage the upper aperture;

releasing water from the lower tank;

water released from the lower tank enables the float to lower, allowing water to again pass from the upper tank though the float housing to the lower tank.

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 1:
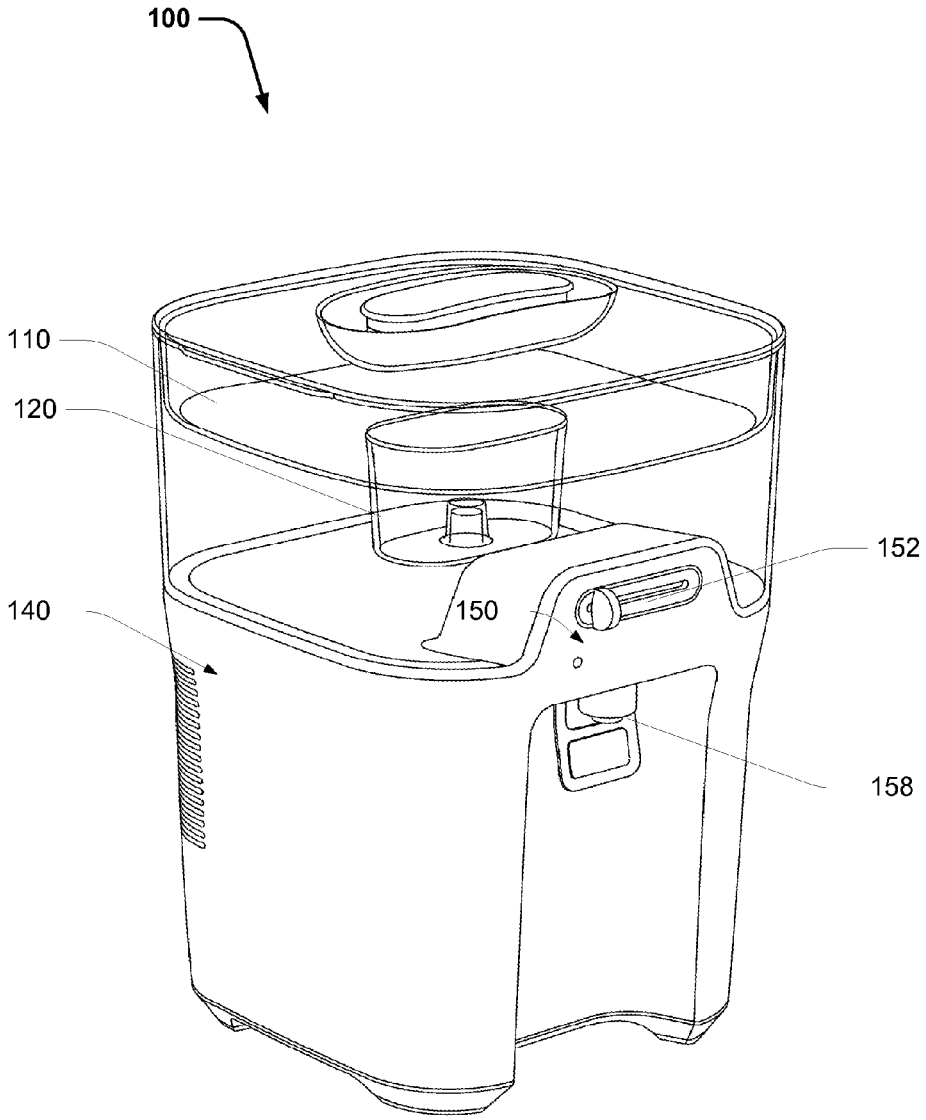
FIG. 1 is a perspective view of an embodiment water dispensing apparatus according to the invention.
Figure 2:
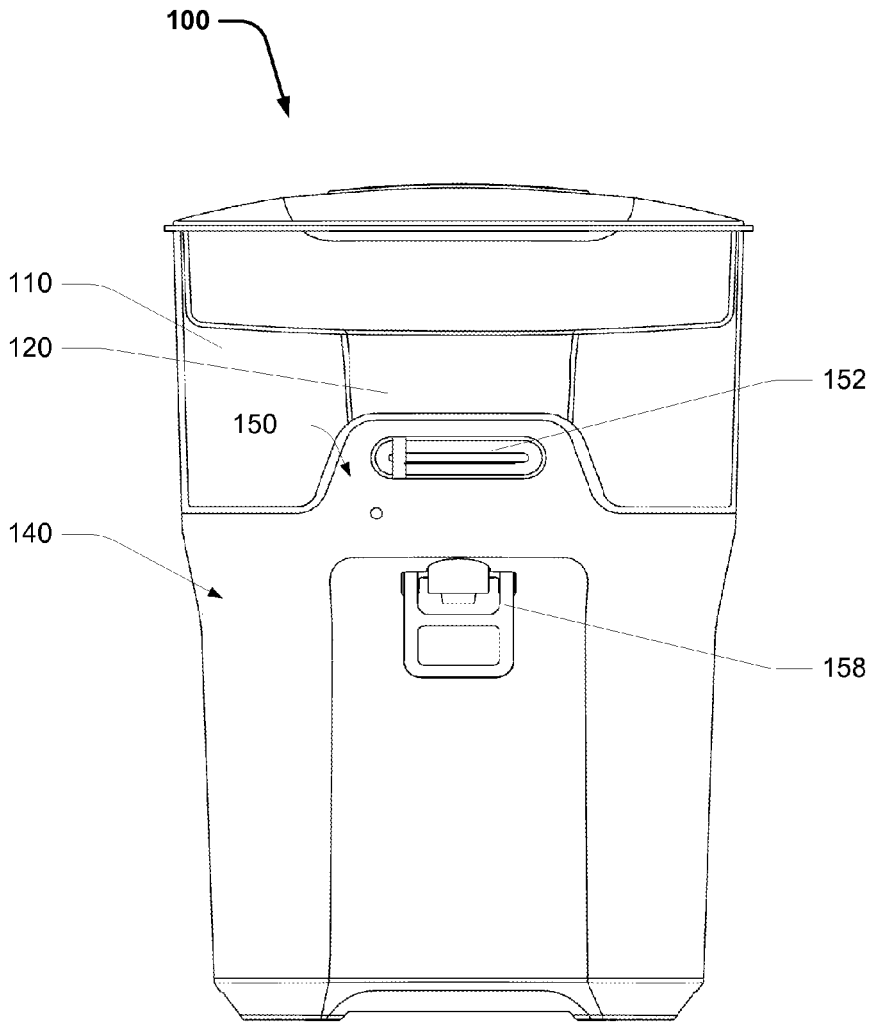
FIG. 2 is a front elevation view of the water dispensing apparatus of FIG. 1.
Figure 3:
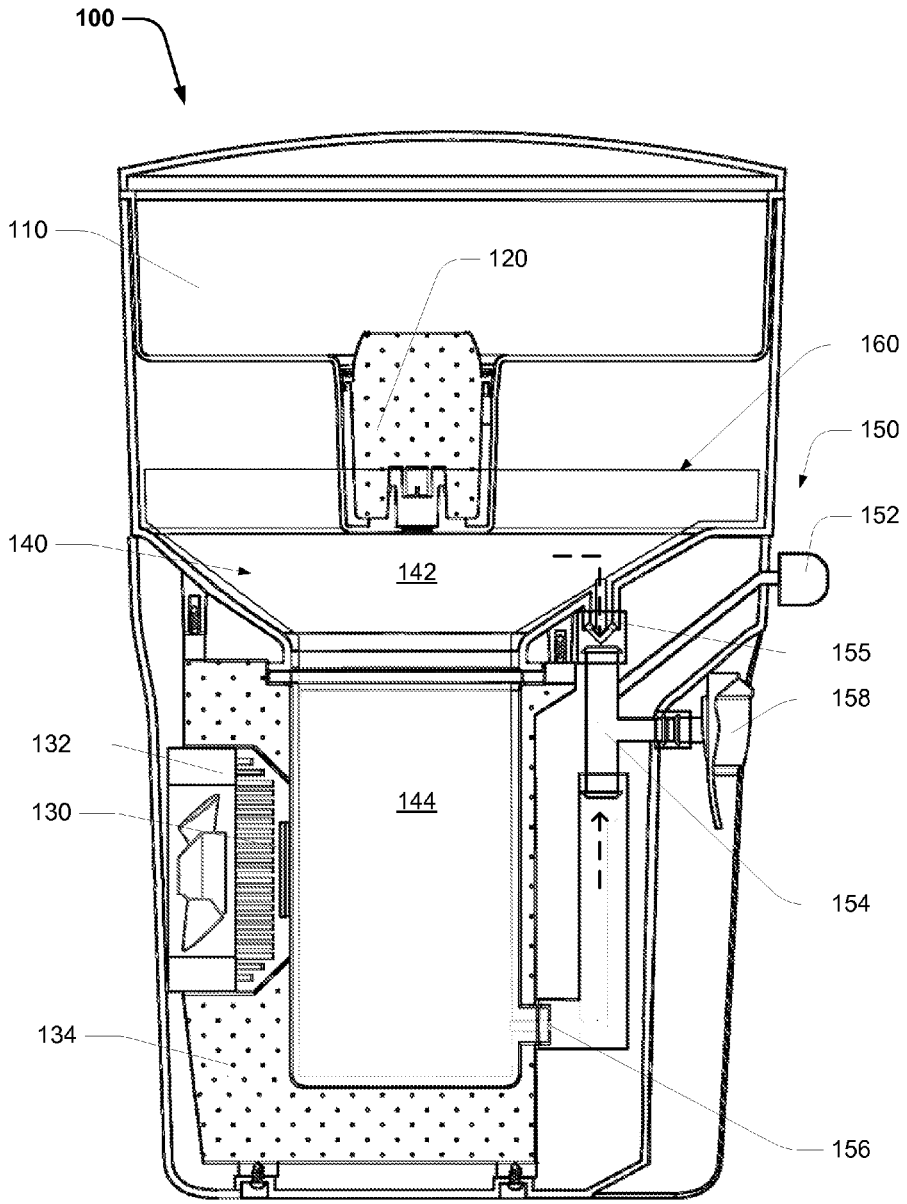
FIG. 3 is a sectional side view of the water dispensing apparatus of FIG. 1.

FIG. 1 through FIG. 3 show an embodiment water dispensing apparatus 100, which can dispense a combination of chilled and ambient temperature water. The apparatus is adapted to provide a configurable water temperature across a range of temperatures.

By way of example, a water dispensing apparatus can include:

a first reservoir 110 for receiving water therein (typically unfiltered water);

a filter 120 in fluid communication with the first reservoir;

a cooling element 130;

a second reservoir 140 in fluid communication with the filter, and adapted to receive and storing filtered water, the second reservoir includes a first portion (or chamber) for storing filtered water at a substantially ambient temperature; the second reservoir includes a second portion (or chamber) operatively associated with the cooling element for storing chilled filtered water;

a water dispensing assembly 150 adapted to receive water from both the first portion and the second portion of the second reservoir at a settable ratio, thereby to dispense water at a configurable temperature.

In this example, the water is gravity fed through a filter 120 to remove harmful chemicals and bacteria from the water. The water then enters the second reservoir 140, preferably filling the first portion (or chamber) 142 and second portion (or cooling chamber) 144. The cooling chamber is a vessel constructed to hold water. By way of example only, this cooling chamber is a tube of a metal (preferably stainless steel) or a plastic. This cooling chamber can holds approximately one litre of water. The first portion (or chamber) 142 a also vessel constructed to hold water. By way of example only, the first portion can include a Styrene Acrylonitrile (SAN), plastic or glass holding tank. This first portion can hold approximately six litres of filtered water at substantially ambient temperature. It will be appreciated that both the cooling chamber and the first portion can be adapted to hold a larger or smaller volume of water. It will be further appreciated that the cooling chamber and the first portion can be constructed of alternative (preferably food grade) materials.

By way of example, a cooling element 130, in the form of a thermoelectric effect "peltier" element can be operatively associated with the second portion (or cooling chamber) 144, for cooling the filtered water. Alternatively, another cooling element such as refrigerated cooling element and the like can be used. A cooling fan 132 can also be included to assist in dissipating heat. The second portion cooling chamber can also be insulated to assist in limiting heat transfer.

By way of example only, a water dispensing assembly 150 is adapted to receive water from both the first portion and the second portion of the second reservoir at a user settable mix ratio, thereby to dispense water at a configurable temperature between ambient water temperature and chilled water temperature. The dispensed water temperature is configured by mixing water from the first portion holding tank (in which the water is at ambient temperature) and water from the second portion cooling chamber which is chilled.

Referring to FIG. 3, an embodiment water dispensing assembly 150 can include an adjustment interface 152 coupled to a mixing valve 154 for setting a mixing ratio of ambient temperature water received though an ambient water aperture 155 and chilled water received though an chilled water aperture 156, thereby to configure the temperature of dispensed water. A dispenser element 158 is in fluid communication with the valve, and includes a stop for enabling dispensing of water at a configurable temperature.

It would be appreciated that, for dispensing water under gravity, the dispenser element is preferably located below the water level 160 held in the second reservoir 140. Preferably, the chilled water aperture is further located proximal to a base of the second portion cooling chamber, being a typically location of cooler water.

Figure 10:
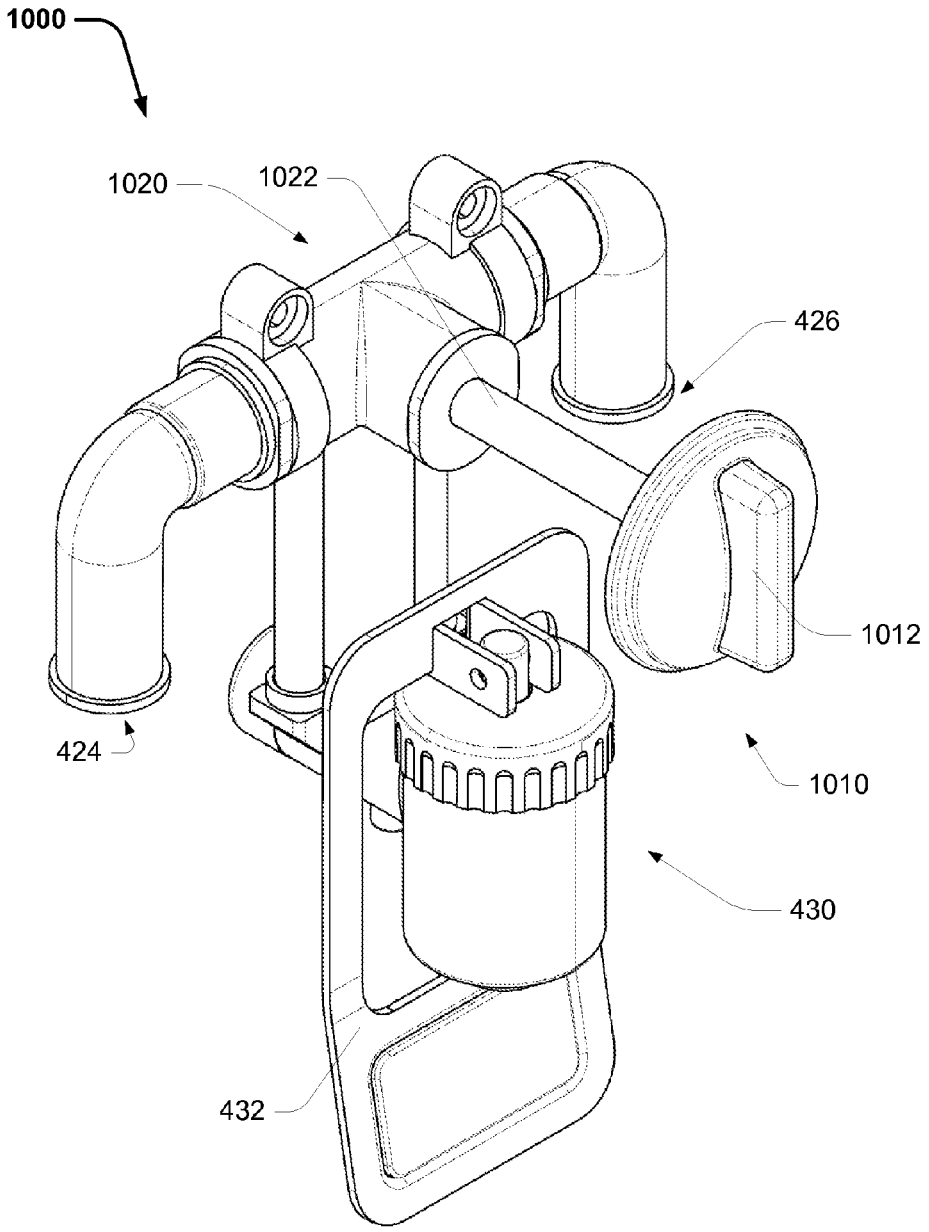
FIG. 10 is a perspective front view of a water dispensing assembly according to the invention.

In this example, the adjustment interface 152 is in the form of a mechanical slider that is mechanically coupled to the mixing valve 154. Alternatively, the adjustment interface can include a rotating dial (for example, as shown in FIG. 10), pushbuttons or even an electronic interface. In alternative embodiments, the adjustment interface can be an electronic adjustment interface having inputs to set a temperature. In further alternative embodiments, the adjustment interface can be electronically coupled to the mixing valve.

It will be appreciated that other means of receive water from both the first portion and the second portion of the second reservoir at a settable ratio can be employed. By way of example, a water dispensing assembly can comprise any assembly adapted to selectively set relative ingress fluid flow from two or more fluid ingress paths in providing at least one fluid egress path.

By way of a further example embodiment, a water dispensing apparatus can include:

a cooling element 130;

a first reservoir portion for storing water at a substantially ambient temperature;

a second reservoir portion for storing chilled water, the second portion being operatively associated with the cooling element;

a water dispensing assembly 150 adapted to receive water from both the first portion and the second portion of the second reservoir at a settable ratio, thereby to dispense water at a configurable temperature.

In this embodiment, the fluid can be supplied to the fluid dispensing assembly under the influence of one or more pumps (not shown). A pump can be operatively associated with supplying water from the first reservoir portion and/or the second reservoir portion to the fluid dispensing assembly.

It will be appreciated that, by way of example only, a first reservoir portion and the second reservoir portion can define separate reservoirs. In this example, the first reservoir portion and/or the second reservoir portion can be positioned independently of each other, or stacked.

It will also be appreciated that a reservoir, and/or a reservoir portion, can comprise a removable vessel, such as a water bottle.

Figure 4:
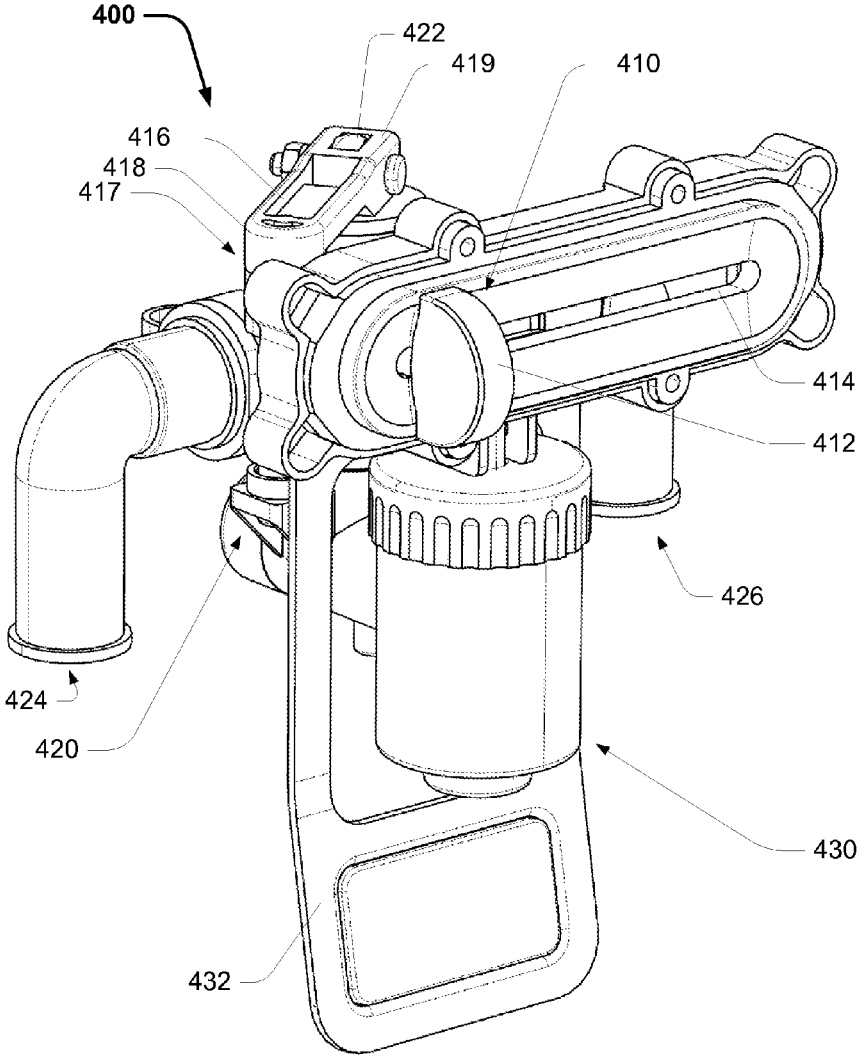
FIG. 4 is a perspective front view of a water dispensing assembly according to the invention.
Figure 5:
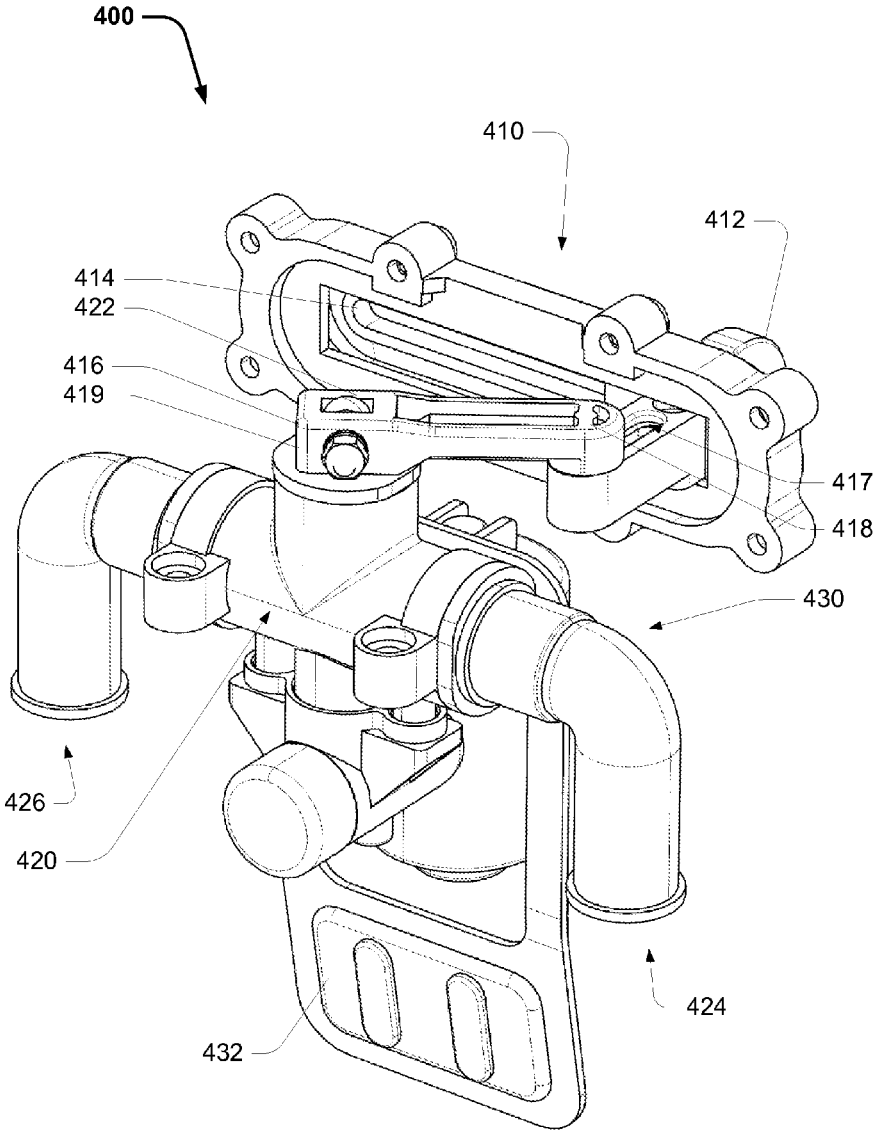
FIG. 5 is a perspective rear view of the water dispensing assembly of FIG. 4.
Figure 9:
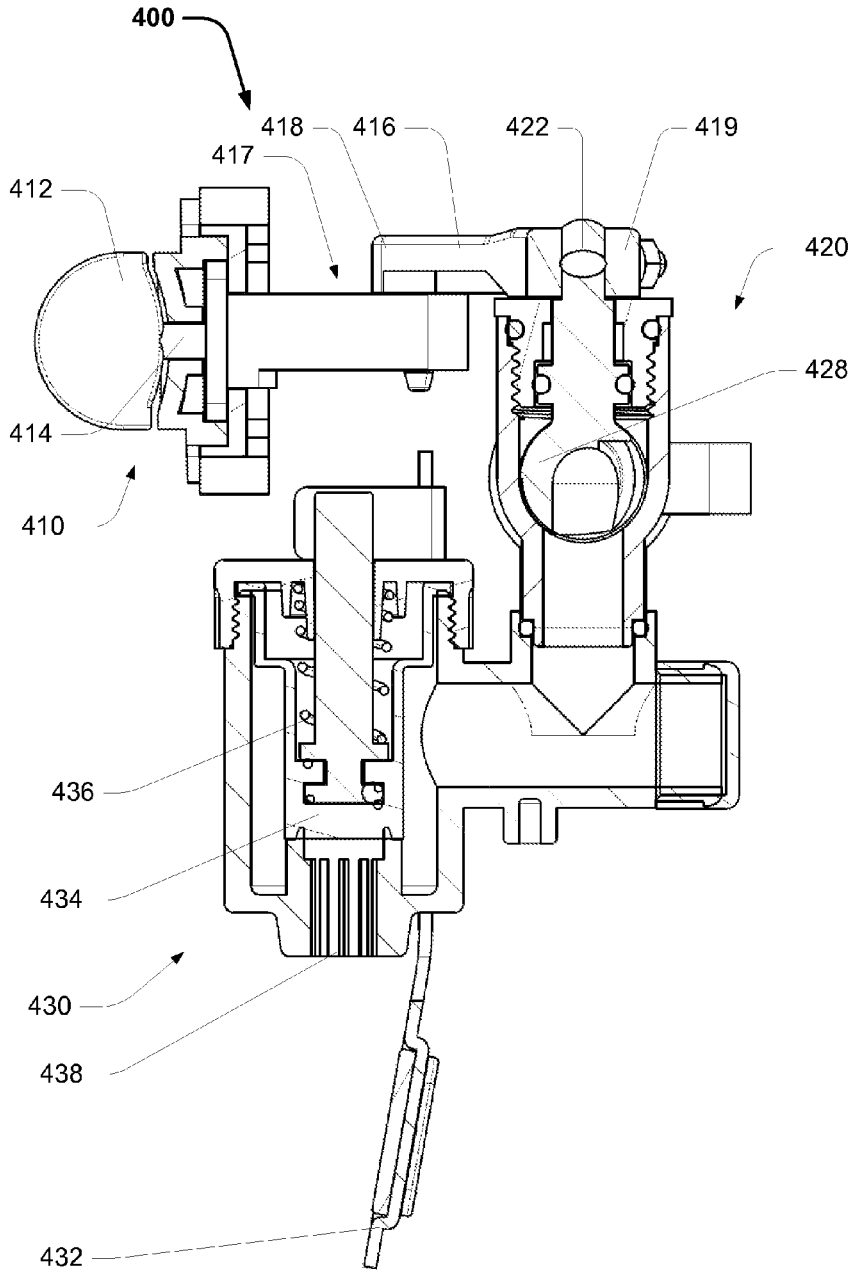
FIG. 9 is a sectional side elevation of the water dispensing assembly of FIG. 4, taken along line 9-9.

Referring to FIG. 4 though FIG. 9, an embodiment water dispensing assembly 400 includes:

an adjustment interface 410;

a mixing valve 420 having a plurality of ingress apertures and at least one egress aperture; and a dispenser element 430, in fluid communication with the at least on egress aperture of the mixing valve.

The mixing valve is coupleable to the adjustment interface for adjusting dispensed water to configured temperature. The dispenser element is adapted to selectively dispense water there from.

In this example, the adjustment interface 410 comprises a slider element 412 located within a guide 414, which is mechanically coupled to the mixing valve 420 by a linkage element 416. The slider has a slotted aperture 417 for receiving one end of the linkage element 418. The other end 419 of the linkage element is releasablly fixed to an actuator 422 of the mixing valve 420, such that relative rotation of the linkage element 416 with respect to the mixing valve 420 sets a mixing ratio of ambient temperature water received though an ambient water aperture 424 and chilled water received though an chilled water aperture 426. It will be appreciated that the slotted aperture 417 is adapted to accommodate the arc swept by the end of the linkage element 418 during rotation for setting the mixing ratio.

In an embodiment, the mixing valve 420 includes a movable blade (or diaphragm) 428 for selectively blocking part of, or all of, the ambient water aperture 424 and/or chilled water aperture 426. In this example the blade is pivotally movable within the mixing valve and fixedly coupled to the actuator 422. It will be appreciated that other means of mixing can be used, and in particular a mixing valve can comprise any assembly adapted to selectively set relative ingress fluid flow from two or more fluid ingress paths in providing at least one fluid egress path.

Figure 6:
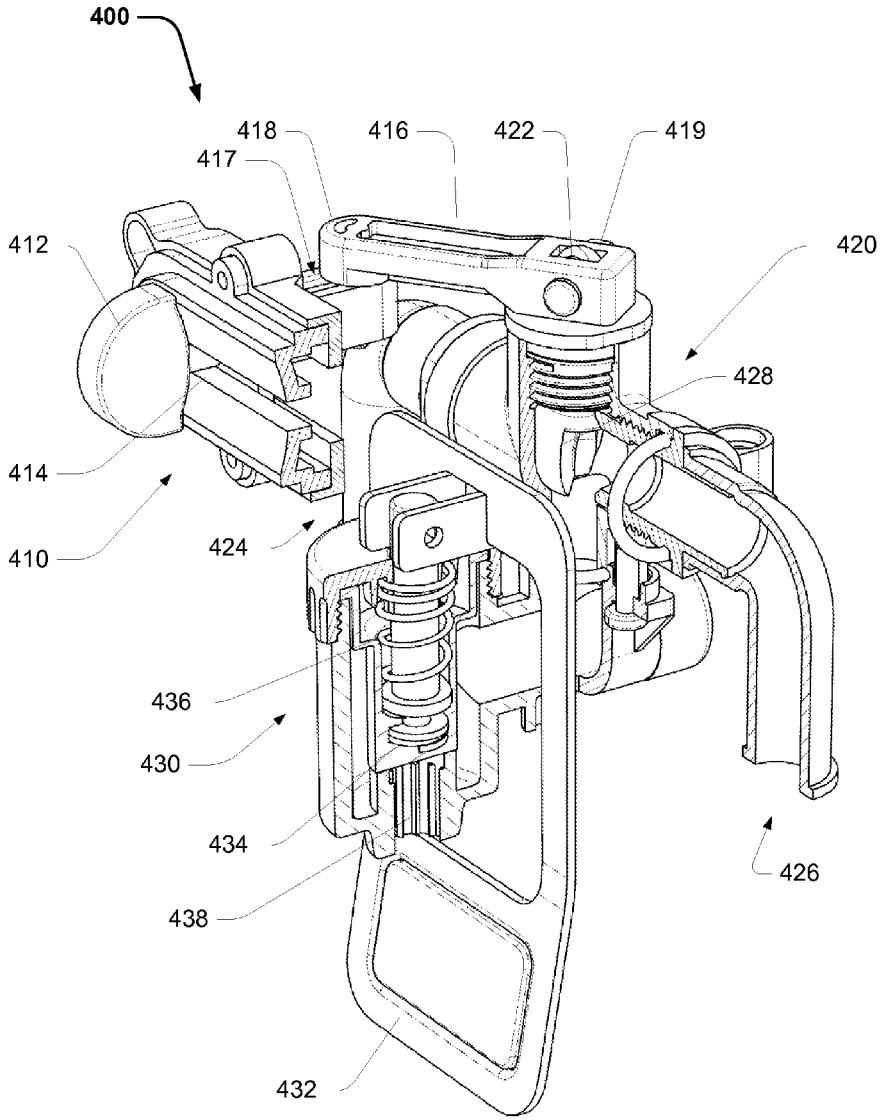
FIG. 6 is a partially sectioned perspective view of the water dispensing assembly of FIG. 4.
Figure 7:
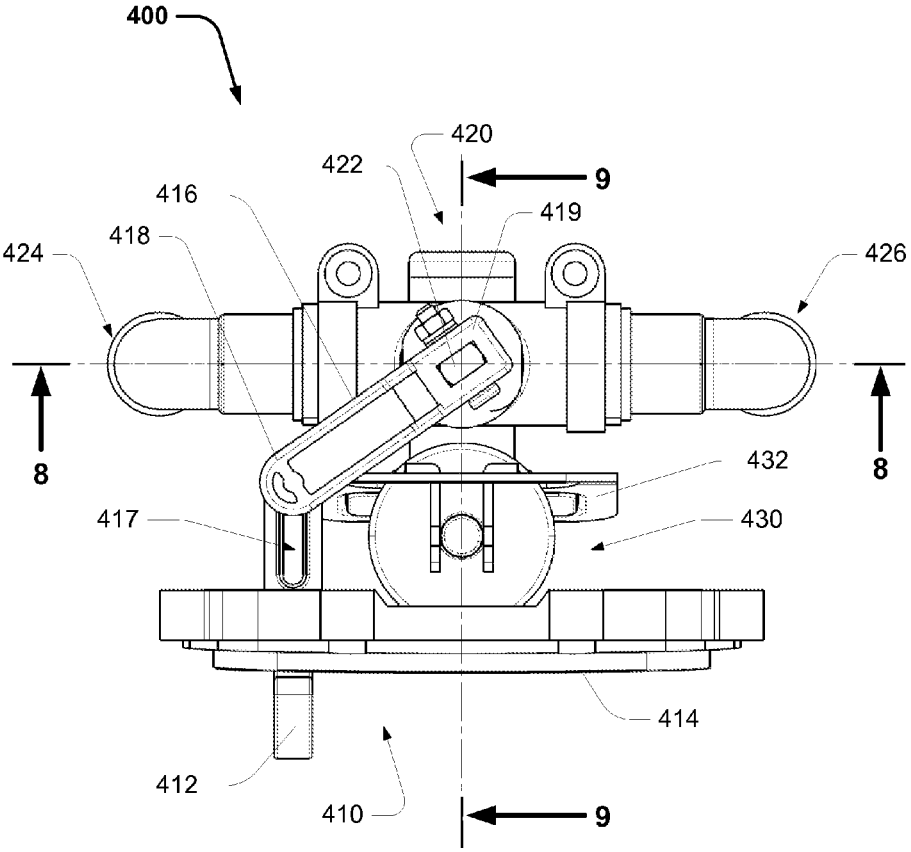
FIG. 7 is a plan view of the water dispensing assembly of FIG. 4.
Figure 8:
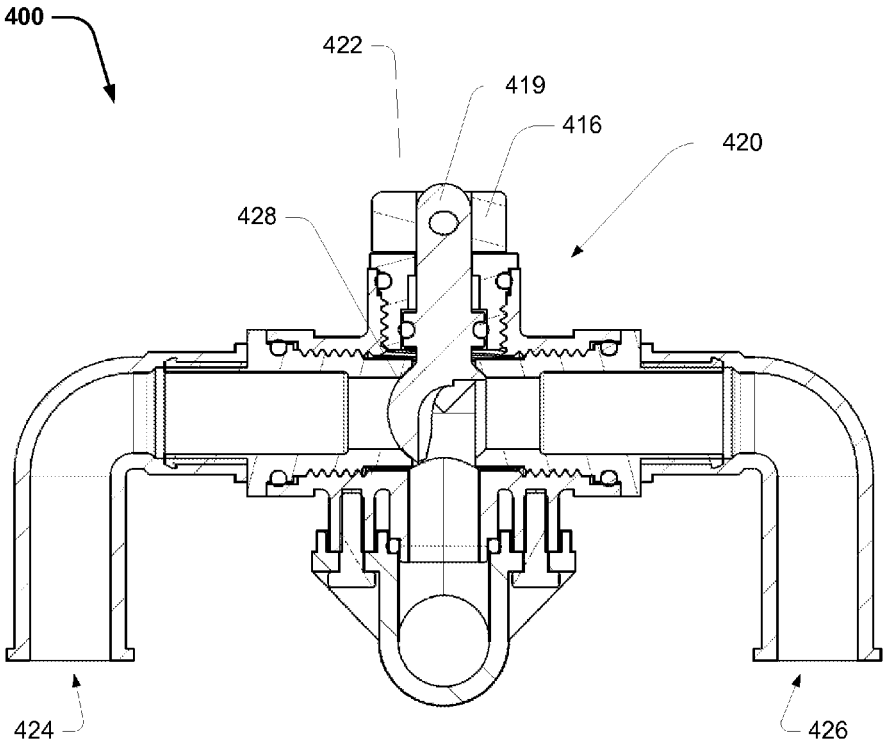
FIG. 8 is a sectional front elevation of the water dispensing assembly of FIG. 4, taken along line 8-8.

As best shown in FIG. 6, with the mixing ratio of ambient temperature water and chilled water set, a dispenser element 430 including a dispenser paddle 432 can be pressed to release a stop 434, thereby enabling dispensing of water under the influence of gravity. A spring 436 can be provided to bias the dispenser element toward returning the dispenser paddle 432 and the stop 434 to a normally closed position.

It will be appreciated that, when the stop 434 is released, a selected flow of ambient water flows from the aperture 424 past the valve blade 428 and to the dispenser element 430 and out the dispensing aperture 438. Similarly, a selected flow of chilled water flows from the aperture 426 past the valve blade 428 and to the dispenser element 430 and out the dispensing aperture 438. In this example, the ambient temperature water and the chilled water mix within the mixing valve 420. It will be appreciated that the ambient temperature water and the chilled water mix external the mixing valve 420. The temperature of dispensed water is configurable across a range of temperatures by selecting the relative ratio of ambient temperature water and chilled water used.

Referring to FIG. 10, an embodiment water dispensing assembly 1000 includes:

an adjustment interface 1010;

a mixing valve 1020 having a plurality of ingress apertures and at least one egress aperture; and a dispenser element 430, in fluid communication with the at least on egress aperture of the mixing valve.

The mixing valve is coupleable to the adjustment interface for adjusting dispensed water to configured temperature. The dispenser element is adapted to selectively dispense water there from.

In this example, the adjustment interface 1010 comprises a rotary dial 1012 mechanically coupled to the mixing valve 1020 by an actuator 1022 of the mixing valve 1020, such that rotation of the rotary dial 1012 with respect to the mixing valve 1020 sets a mixing ratio of ambient temperature water received though an ambient water aperture 424 and chilled water received though an chilled water aperture 426.

In an embodiment, the mixing valve 1020 includes a movable blade (or diaphragm) for selectively blocking part of, or all of, the ambient water aperture 424 and/or chilled water aperture 426. In this example the blade is pivotally movable within the mixing valve and fixedly coupled to the actuator 1022.

It will be appreciated that, in this embodiment, both the ambient water and the chilled water are delivered from a common body of water contained within a reservoir. By way of example, this reservoir includes a first portion (or chamber) for storing water at a substantially ambient temperature and a second portion (or chamber) operatively associated with the cooling element for storing chilled filtered water. The first portion and the second portion being in fluid communication. In this embodiment, by having the mixing valve and dispenser element below the level of water in the reservoir enables the ambient water and the chilled water to be supplied under gravity at substantially the same pressure.

In an alternative embodiment, ambient temperature water and chilled water can be provided from separate reservoirs. By maintaining the water level of the separate reservoirs at similar levels, a similar water pressure may be maintained. The separate reservoirs can be in temporary fluid communication for maintaining or establishing a substantially similar water level.

In an alternative embodiment, the water is supplied to the water dispensing assembly 400 under the influence of one ore more pumps (not shown). In this example embodiment, the one ore more pumps can be operatively associated with the ambient water aperture 424 and/or the chilled water aperture 426.

Figure 11:
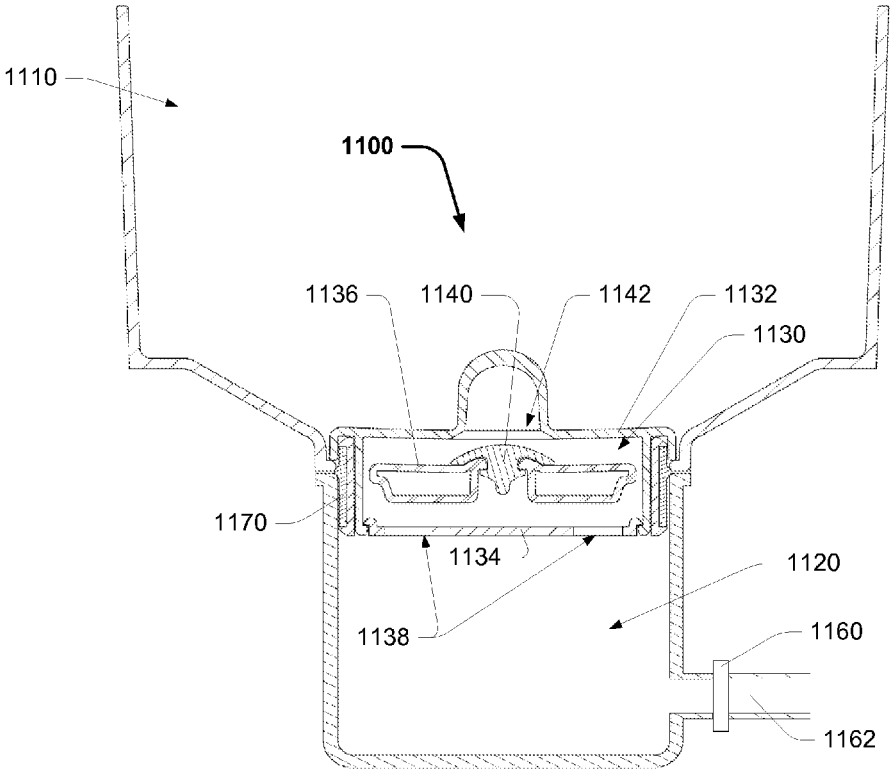
FIG. 11 is a sectional view of a float assembly for a water dispensing assembly according to the invention.

FIG. 11 shows an example embodiment water level control assembly 1100 for restricting fluid flow between reservoirs. The assembly 1100 can be used to restrict flow from the upper tank 1110 to a lower tank 1120, and/or operate in maintaining water levels in the lower tank.

This water level control assembly 1100 can comprise: a float housing 1130 defining a upper extent 1132 and an lower extent 1134; and a float 1136. The float housing having one or more lower drain apertures 1138 for enabling fluid flow communication between the float housing and lower tank. The float having a seal element 1140 for sealingly engaging an upper aperture 1142 in the upper tank for restricting fluid flow from the upper tank to the float housing. A release valve 1160 can be operatively associated with the lower tank to releasing water there from via a fluid conduit 1162. A housing seal 1170 can locate and seal the housing between one or both of the upper tank and lower tank.

This water level control assembly 1100 can be included between the first portion (or chamber) 142 and second portion (or cooling chamber) 144 of a water dispensing apparatus (for example apparatus 100 best shown in FIG. 1 through FIG. 3).

Figure 12A:
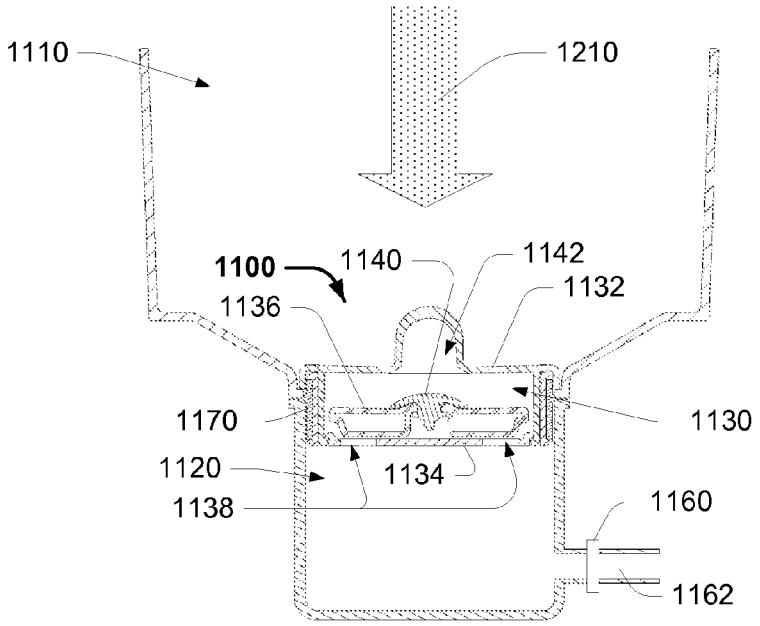
FIG. 12A though 12G are sectional views of a float assembly of FIG. 11, shown receiving and dispensing water.
Figure 12B:
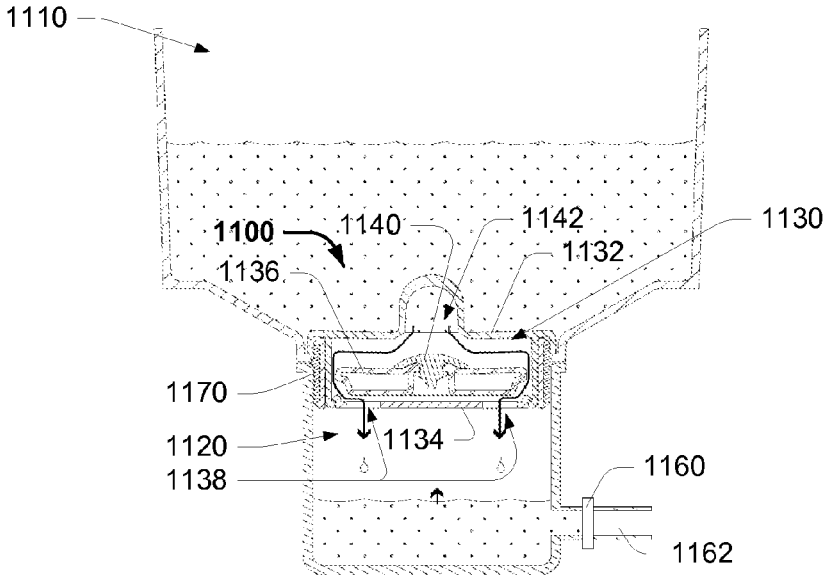
Figure 12C:
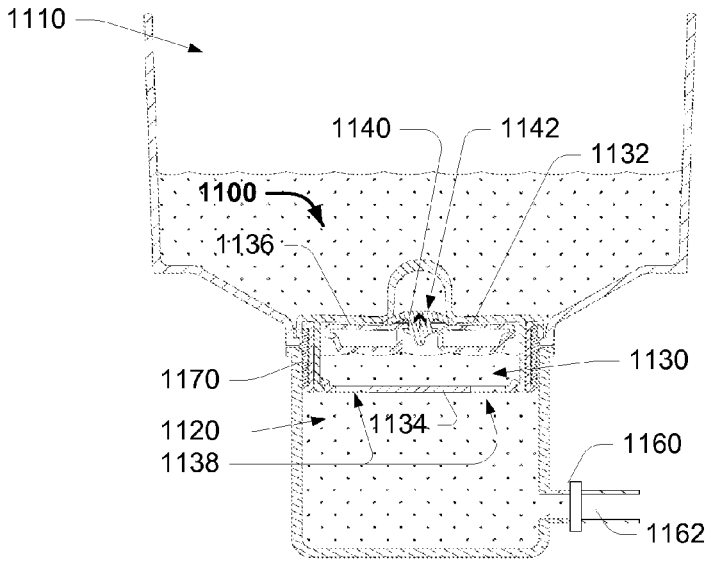
Figure 12D:
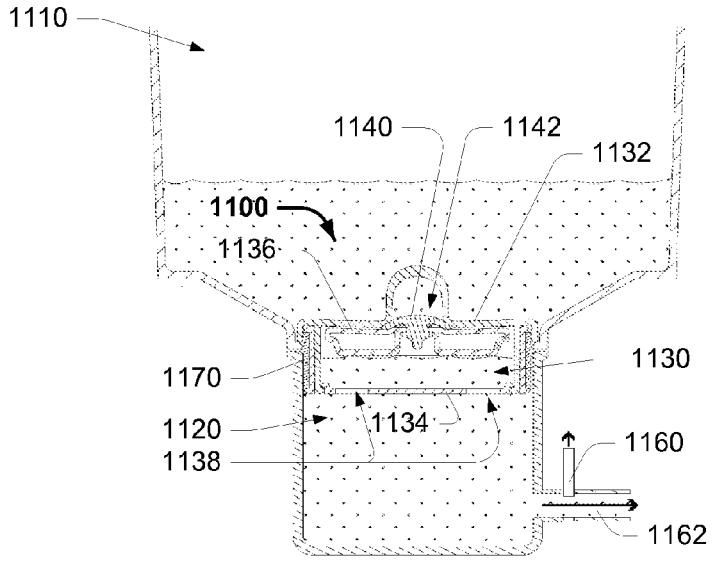
Figure 12E:
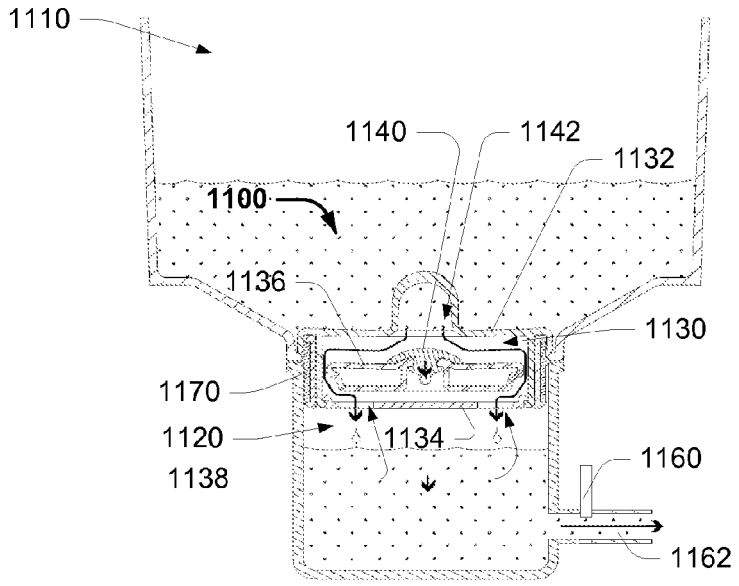
Figure 12F:
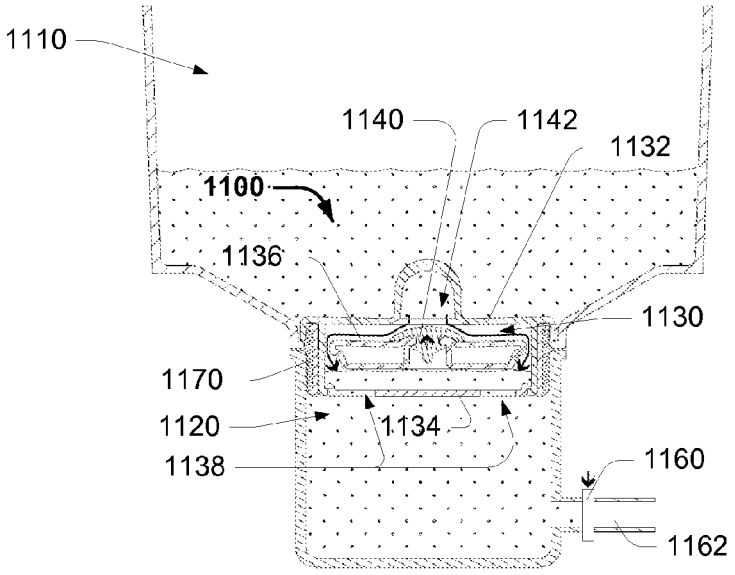
Figure 12G:
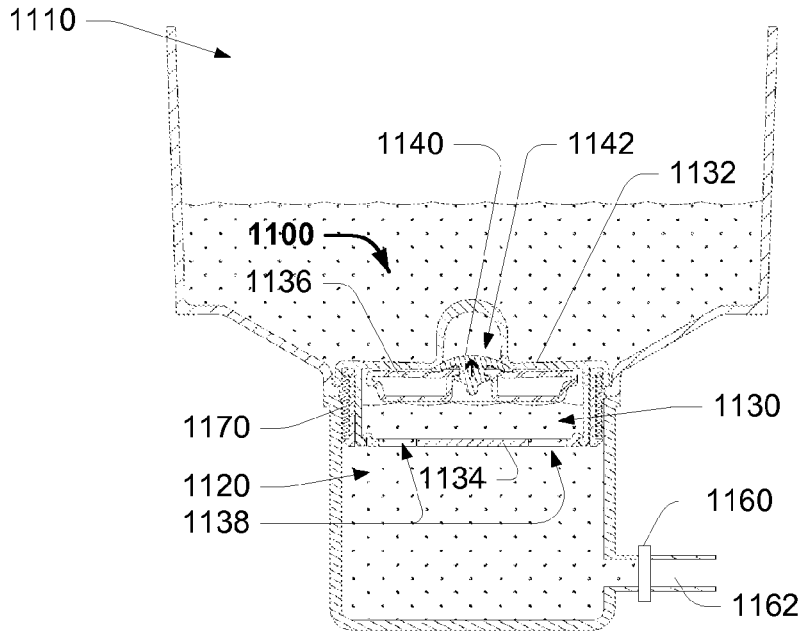

Referring to FIG. 12A though FIG. 12G, operation of a water level control assembly 1100 can comprise:

FIG. 12A—as water 1210 is first added to the upper tank, the float rests on the lower extent of the float housing;

FIG. 12B—as water enters float housing via an upper aperture, flowing around the float and though the lower apertures into lower tank, thereby enabling filling the lower tank;

FIG. 12C—as water continues to enter the upper tank, filling the lower tank, once the lower tank becomes filled further water flow raises the float, enabling the float seal to engage the upper aperture to create a sealing engagement;

FIG. 12D—release valve can be opened to release water from the lower tank;

FIG. 12E—water released from the lower tank enables the float to lower, allowing water to pass from the upper tank though the float housing to the lower tank;

FIG. 12F—when the release valve closes, water level in the lower tank can rise, eventually filling the lower tank and causing the float to rise;

FIG. 12 G—when the lower tank is full, the float can again rise to cause sealing engagement between the float seal and upper aperture, thereby again restricting water flow, thereby restricting water flow from the upper tank to the lower tank.

It will be appreciated that the disclosed water dispensing apparatus provides a method of dispensing water at a configurable temperature. By mixing the water from a cooling chamber with the water from the storage tank (which is typically at room temperature), a user can adjust dispensed water temperature to their desired setting.

It will be appreciated that the illustrated water cooler apparatus has a configurable temperature set. It will be further appreciated that the illustrated water dispensing assembly when used with a water cooler apparatus enables a configurable temperature set.

Although the invention has been described with reference to specific examples, it will be appreciated by those skilled in the art that the invention may be embodied in many other forms.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A fluid dispensing apparatus for providing a configurable fluid temperature, the assembly including:

a reservoir;

a flow control element located within the reservoir for defining a first reservoir portion above the flow control element and a second reservoir portion below the flow control element;

the flow control element defining a fluid flow communication path between the first reservoir portion and the second reservoir portion; the flow control element defines an inner cavity having a plurality of lower drain apertures for enabling fluid flow communication between the cavity and the second reservoir portion; wherein the flow control element further substantially restricts fluid flow from the first reservoir portion to the second reservoir portion when the second reservoir portion is full;

a cooling element configured to chill fluid stored within the second reservoir portion;

a fluid dispensing assembly adapted to receive fluid from both the first reservoir portion and the second reservoir portion at a settable ratio, thereby enabling fluid to be dispensed at a configurable temperature;

wherein the fluid dispensing assembly includes a mixing valve and a dispenser element;

the mixing valve having a plurality of fluid ingress apertures and at least one fluid egress aperture; the mixing valve being adjustable to dispense fluid at a configurable temperature; and the dispenser element being in fluid communication with the at least one egress aperture of the mixing valve and adapted to selectively dispense fluid there from.

2. The apparatus according to claim 1, wherein the reservoir comprises a single body of fluid divided into the first reservoir portion and the second reservoir portion by the flow control element; the plurality of ingress apertures are in fluid communication with the reservoir.

3. The apparatus according to claim 1, wherein the fluid is supplied to the mixing valve under the influence of gravity.

4. The apparatus according to claim 1, wherein fluid is received by the fluid dispensing assembly from both the first reservoir portion and the second reservoir portion at substantially the same pressure.

5. The apparatus according to claim 1, wherein fluid is supplied to the mixing valve under the influence of one or more pumps, and the one or more pumps being operatively associated with supplying fluid to each of the plurality of fluid ingress apertures.

6. The apparatus according to claim 1, the fluid dispensing apparatus further including:

a receptacle for receiving fluid; and a filter in fluid communication between the receptacle and reservoir; the filter being configured to supply filtered fluid to the reservoir.

7. The apparatus according to claim 1, wherein the fluid dispensing assembly is located, in use, below the level of fluid contained in the first reservoir portion.

8. The apparatus according to claim 1, wherein the flow control element comprises: a float housing defining the cavity having a lower extent and an upper extent; and a float located within the cavity.

9. The apparatus according to claim 8, wherein the float housing includes:

one or more upper aperture for enabling fluid flow communication between the first reservoir portion and the cavity; and the plurality of lower drain apertures enabling fluid flow communication from the cavity to the second reservoir portion.

10. The apparatus according to claim 9, wherein the float includes a seal element for sealingly engaging an upper aperture for restricting fluid flow from the first reservoir portion to the cavity.

11. The apparatus according to claim 10, wherein the fluid is water.

12. The apparatus according to claim 1, wherein the flow control element comprises: a float housing defining the cavity having a lower extent and an upper extent; and a float located within the cavity that restricts fluid flow from the first reservoir portion to the second reservoir portion when the second reservoir portion is full.

13. The apparatus according to claim 12, wherein the float housing includes:

an upper aperture for enabling fluid flow communication from the first reservoir portion to the cavity; wherein the float includes a seal element for sealingly engaging the upper aperture for restricting fluid flow from the first reservoir portion to the cavity.

* * * * *